United States Patent [19]

Watt, Jr. et al.

[11] 4,082,243

[45] Apr. 4, 1978

[54] COLLAR ATTACHMENT FOR SUPPORT HOOK

[75] Inventors: William Doyle Watt, Jr., Grand Rapids; Dale L. Flowerday, Holland, both of Mich.

[73] Assignee: Keeler Corporation, Grand Rapids, Mich.

[21] Appl. No.: 743,005

[22] Filed: Nov. 18, 1976

[51] Int. Cl.[2] ..... F16B 45/00

[52] U.S. Cl. ..... 248/205 R; 248/304

[58] Field of Search ..... 248/304, 345, 344, 343, 248/342, 200, 205 R, 212, 213, 235, 425 R, 27.1; 85/1 H

[56] References Cited

U.S. PATENT DOCUMENTS

| | | | |
|---|---|---|---|
| 309,621 | 12/1884 | Herrick et al. | 248/304 |
| 423,730 | 3/1890 | Charlton | 248/304 |
| 620,872 | 3/1899 | Park | 85/1 H |
| 984,647 | 2/1911 | Carlson | 248/343 |
| 1,958,497 | 5/1934 | Rivers | 85/1 H |
| 2,338,928 | 1/1944 | Glitsch | 248/205 R |
| 3,053,555 | 9/1962 | Lahti | 85/1 H |

FOREIGN PATENT DOCUMENTS

| | | | |
|---|---|---|---|
| 1,920,526 | 10/1970 | Germany | 248/304 |
| 576,676 | 5/1958 | Italy | 85/1 H |
| 119,696 | 9/1947 | Sweden | 248/304 |
| 237,950 | 3/1946 | Switzerland | 248/200 |
| 430,331 | 8/1967 | Switzerland | 248/343 |
| 1,069,702 | 5/1967 | United Kingdom | 85/1 H |

*Primary Examiner*—Marion Parsons, Jr.

*Attorney, Agent, or Firm*—Price, Heneveld, Huizenga & Cooper

[57] ABSTRACT

A support assembly for attachment to a supporting surface, and preferably a vertical surface, as well as a method for assembling such a support. The assembly includes a support such as a garment hook or the like, a base on said support and a continuous retaining collar for securing the base and support to the supporting surface. The retaining collar has a base-receiving aperture smaller than the outer periphery of the base for overlapping and holding the base against the supporting surface. Although the support itself such as the garment hook is too large to allow passage of the collar thereover, assembly with the support base is accomplished by inserting only a portion of the base through the collar aperture, rotating one of the collar and base with respect to the other to pass the remainder of the base through the aperture, and seating the base against the back of the collar.

17 Claims, 14 Drawing Figures

COLLAR ATTACHMENT FOR SUPPORT HOOK

BACKGROUND OF THE INVENTION

This invention relates to supports such as garment hooks and more particularly, to means for securely attaching such supports to supporting surfaces such as vertically extending walls and the like.

In the attachment of supports such as garment hooks to surfaces and especially vertical surfaces, a problem is often encountered in attempting to obtain secure, reliable, strong attachment. In certain cases, it is preferable to extend fasteners or other securing means to the back of the hook or other support directly through the supporting surface to ensure that the hook will remain on the wall and support its intended load. Such rear, through-the-wall or panel attachment is useful where the support is to be attached to a wall panel, door, or other similar structure which is accessible from its rear surface.

However, when such rear access is not available, the support hook must be mounted directly on the surface to which it is to be attached and must be secured adequately from only that surface alone. In such cases, the extending or projecting support must be able to support extremely large loads in a cantilevered manner. Accordingly, support engagement around the entirety of a support area on the garment hook or the like is preferable. Because of the size of the garment hook or other support which often is much larger than its base or securing area, it has been difficult to obtain continuous engagement around the entire support base or attaching area with prior known structures because that attaching means cannot be introduced over the support such as a garment hook and around the base structure.

Certain prior structures have used one member including an aperture equal to or larger than the size of the support base or attaching means to allow passage therethrough. Such arrangements not only leave unsightly apertures after assembly but also fail to provide the continuous, secure support obtainable with the present invention.

SUMMARY OF THE INVENTION

Accordingly, the present invention provides a solution to the above problems by providing a support assembly and a method for assembling the elements of the assembly which results in a strong, secure and reliable attachment for a support, such as a cantilever-type garment hook, to a supporting surface, and preferably to a vertical supporting surface even where rear, through-the-wall attachment cannot be made. The assembly is susceptible of making such an attachement to either a vertical or horizontal surface or any other surface intermediate those directions. Included are a support such as a garment hook for hanging clothing items and the like and means for attaching the support to a supporting surface. The support includes a base, with the attaching means including a collar for holding the base against the supporting surface. The collar includes an aperture extending therethrough for securing the collar to the base as well as cooperating means for initially allowing insertion of only a portion of the base through the base-receiving aperture and thereafter allowing rotation of one of the base and collar with respect to the other to insert the remainder of the base behind the collar. Thus, the collar overlaps the base after assembly so as to securely hold the base against the support surface.

In more particular aspects of the support assembly, the base defines an area larger than the base-receiving aperture of the collar. The base is dimensioned so as to be fitted through the base-receiving aperture of the collar in the above-defined manner, namely, partial insertion followed by rotation to bring the remainder of the base through the collar. In a preferred embodiment, one of the length, width, diagonal or thickness dimensions of the base is less than at least one of the length, width or diagonal dimensions of the base-receiving aperture measured from edge to edge across the collar aperture. Preferably, the thickness of the base is less than the length and width of the aperture.

In other aspects, the collar includes an inwardly directed flange extending around the entire periphery of the base which mates with a recessed shoulder in the peripheral edge of the base to form a flush, contoured retention of the base against the supporting surface.

The invention also comprises a method for assembling a support assembly including a support having a base for engagement with a surface with a collar for extending around and overlapping the peripheral edge of the base to hold the base against a surface. The collar includes a base-receiving aperture therethrough which is smaller than the peripheral edge outlined by the base. The method includes the steps of (1) inserting a portion of the base through the base-receiving aperture in the collar, (2) rotating at least one of the base and collar with respect to the other so that the remainder of the base passes through the base-receiving aperture, and (3) seating the base against the collar by bringing the rear surface of at least the portion of the collar which outlines the aperture into engagement with the top surface of the base.

The present invention solves the above-enumerated problems by allowing attachment of the support such as the garment hook totally from the front of the surface to which it is secured. Where rear access can be obtained, support attachment can be made totally from the rear of the supporting surface or both from the front and rear. In this respect, the base of the support in the preferred embodiments includes means for receiving fasteners from the rear in addition to the collar for holding it against the front surface as defined above. The invention provides a strong, secure and yet reliable inexpensive method for providing a continuous collar around a base for securing a support even though the support itself is too large to allow the retaining collar or attaching means to be passed thereover. The invention is also susceptible of being manufactured in many and varying configurations thereby enhancing the aesthetic appeal of the invention when applied to various articles.

These and other objects, advantages, purposes and features of the invention will become more apparent from a study of the following description taken in conjunction with the drawings.

DESCRIPTION OF THE PREFERRED EMBODIMENTS

Figure 1:
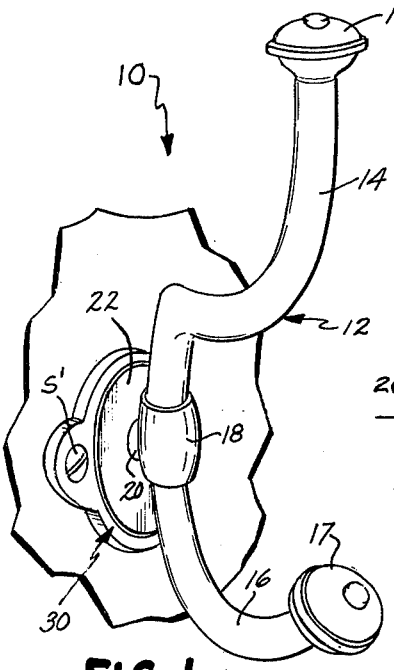
FIG. 1 is a perspective view of the support assembly of the present invention secured to a vertical support surface such as a wall or panel.

Referring now to the drawings in greater detail, FIGS. 1–4 illustrate a first embodiment of the invention including a support designed for attachment to a supporting surface such as a wall, panel, or the like. In the present case, the support is a garment hook 12 including an upper arm 14 and a lower arm 16, each arm terminating in an enlarged, integral knob 15 or 17, respectively, over which garments such as hats and coats may be placed for storage. Support arm 14 extends first upwardly, then outwardly, and finally upwardly again while lower support arm 16 curves downwardly and then outwardly from a central support 18. Central support 18 is formed in one piece with a connecting neck member 20 and base 22 for the support hook 12.

Figure 2:
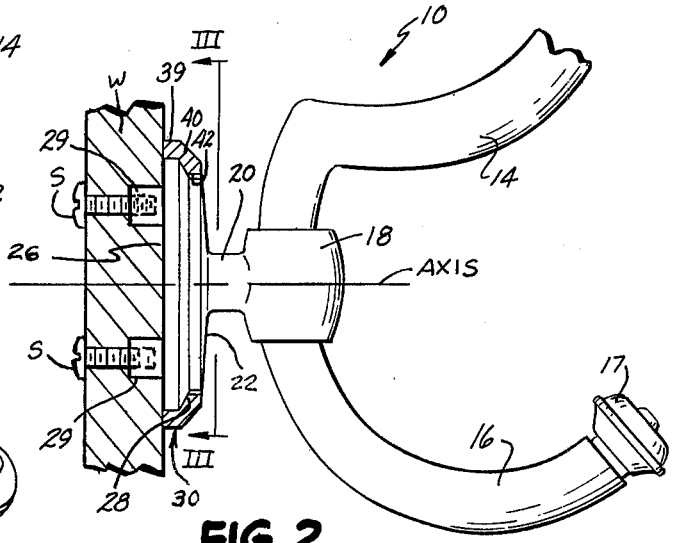
FIG. 2 is a fragmentary, side elevation of the support assembly with the collar and wall support surface taken in cross section to illustrate attachment of the support to the wall.

Connecting neck member 20 extends generally normally outwardly from the top surface of base 22 to provide a space between the arms 14, 16 and central support 18 and the top surface of the base. Base 22 also includes an outer peripheral edge which, in the case of FIGS. 1–4, generally has an oval or elliptical shape, a rear surface 26 and a recessed shoulder 28 extending around its entire periphery. Rear surface 26 is generally planar such that it will engage a planar surface of a wall or other panel for attachment of the support 12 typically in a vertical orientation as shown in FIGS. 1 and 2. To hold the support in its attached position, a collar 30 is preferably positioned around the periphery of the base 22 in the manner described hereinafter such that it is seated in the shoulder 28 to hold the support base and thus the support 12 tightly and securely against the support wall. In such case, projecting cylinders 29 formed in one piece on the back surface 26 of the base project into the wall surface to prevent the support from rotating from its vertical position. Alternately, if the collar 30 cannot be used, or additional securement is desired, projections 29 are bored and internally threaded to receive securing screws S (FIG. 2) extending from the rear of the wall surface W into the projections to provide additional securing strength. Either screws S and projections 29 or the retaining collar 30 or both may be used to secure support 12 on a supporting surface lying at virtually any angle, namely, horizontal, vertical or angles therebetween.

Retaining collar 30 is generally continuous and outlines the peripheral shape of the base 22. Collar 30 includes a pair of laterally outwardly extending securing ears 32, 34 each of which includes an aperture 36 therethrough for receiving a securing screw S′ (FIG. 1). The primary portion of collar 30 is a retaining flange 38 which is generally L-shaped in cross section. As shown in FIG. 2, flange 38 includes an outwardly extending flange portion 39 which joins an inwardly extending flange 40 which ends in an edge 42 defining the base-receiving aperture of collar 30. The base-receiving aperture has an access opening generally normal to the plane of extension of the entire collar 30 and extends entirely through the collar and communicates with the recessed pocket within the collar Edge 42 of flange 40 is spaced outwardly from the rear surface of collar 30 and thus from any wall or other supporting surface against which the collar is fitted to define an internal recess or pocket which receives base 22 when the retaining collar and base are assembled together. Thus, the rear edge or surface of collar 30 is nearly flush with the rear surface 26 of base 22 after assembly. Typically, the rear edge of the collar is spaced slightly away from the supporting surface to assure tight clamping of base 22 thereagainst although it appears to be nearly flush. Edge 42 outlines the same shape as recessed shoulder 28 and extends outwardly at the same angle as the top surface of the shoulder 28 (FIG. 2). After assembly, the top surface of flange 40 is flush with the topmost surface of base 22, at least in the embodiment of FIGS. 1–4.

Preferably, the outer periphery 24 of base 22 is parallel to the outer periphery of flange 38 as well as to the shape of edge 42 and shoulder 28 although the latter is not absolutely necessary. Principally, the outer contour of base 22 is determined by the shape of the pocket or recess within the retaining collar.

Figure 3:
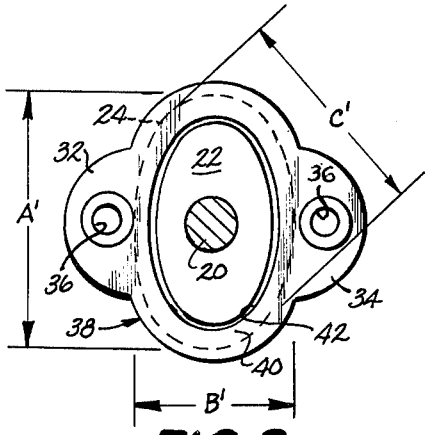
FIG. 3 is a front elevation of a portion of the support assembly taken along plane III—III of FIG. 2.
Figure 4:
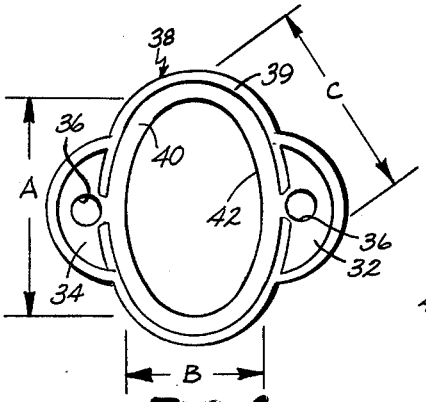
FIG. 4 is a rear elevation of the retaining collar of the present invention.

As shown in FIGS. 3 and 4, a particular feature of the invention is the comparative sizes of the aperture defined by edge 42 which extends through collar 30 and the outer periphery of base 22. In order to obtain the proper, overlapping secure support of the collar against the base 22, aperture 42 is smaller than the area defined by the outer periphery of base 22. Further, the respective length, width and diagonal dimensions of the aperture 42 (denoted by letters A, B and C, respectively, in FIG. 4) are smaller than the corresponding length, width and diagonal dimensions of the base 22 (denoted by letters A′, B′ and C′ in FIG. 3). In addition, as will be best seen in FIG. 2, the thickness of base 22, including the length of projections 29, is less than either the length, width or diagonal dimensions of the base-receiving aperture 42 of collar 30. Preferably, the width B′ of base 22 is also less than the length A of collar 30, but this is not absolutely necessary for assembly. The lesser thickness of the base 22 than the length, width and diagonal dimensions of the aperture 42 allows the partial insertion and rotation assembly method of the collar over the base as is more fully described hereinafter even though the support 12 including arms 14, 16 is too large to allow passage of the collar 30 thereover.

Figure 7:
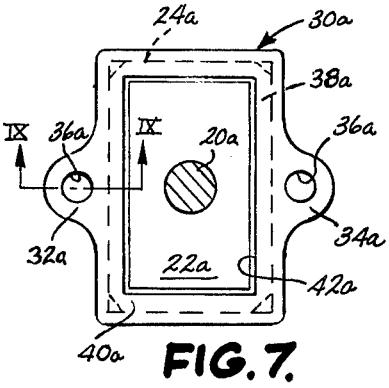
FIG. 7 is a front elevation of the base and retaining collar of a second, rectangular embodiment of the invention.
Figure 8:
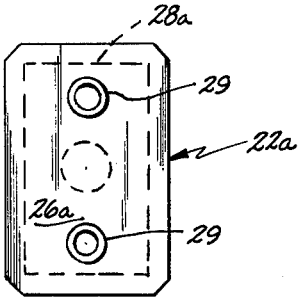
FIG. 8 is a rear elevation of the base of the second embodiment of the invention shown in FIG. 7.
Figure 10:
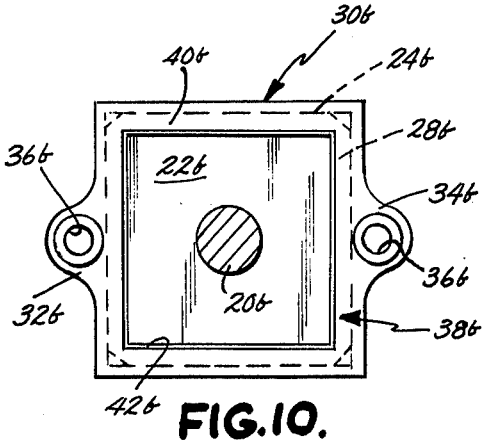
FIG. 10 is a front elevation of a support base and retaining collar assembly of a third, square embodiment of the assembly.
Figure 11:
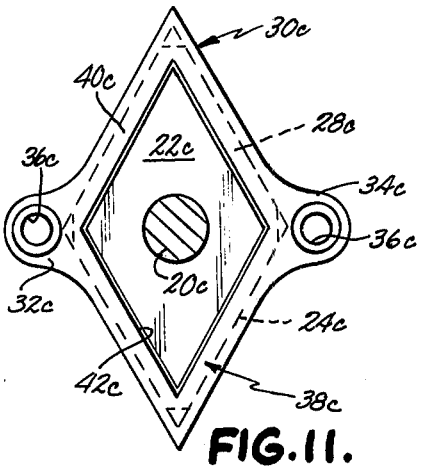
FIG. 11 is a front elevation of a support base and retaining collar assembly of a fourth, diamond-shaped embodiment of the invention.
Figure 12:
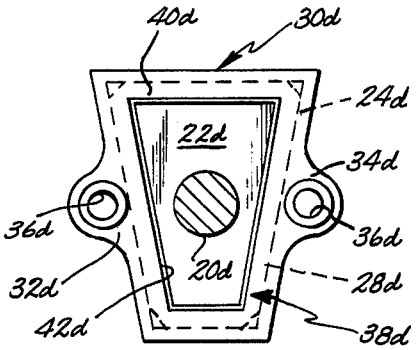
FIG. 12 is a front elevation of a support base and retaining collar assembly of a fifth, truncated triangular embodiment of the invention.
Figure 13:
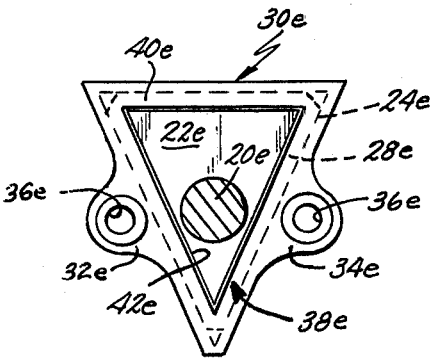
FIG. 13 is a front elevation of a support base and retaining collar assembly of a sixth, triangular embodiment of the invention.
Figure 14:
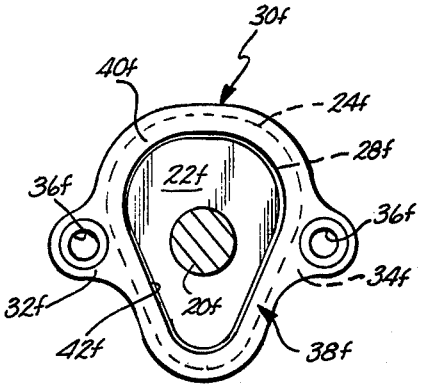
FIG. 14 is a front elevation of a support base and retaining collar assembly of a seventh, rounded-triangular embodiment of the invention.
Figure 9:
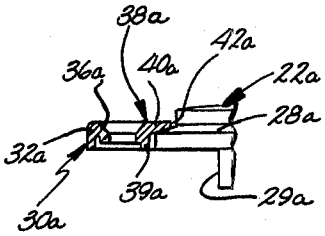
FIG. 9 is a fragmentary, side elevation showing a portion of the base and retaining collar taken along plane IX—IX of FIG. 7 with the retaining collar being shown in cross section.

As will be seen from FIGS. 7–14, the support base for hook or other support 12 and the retaining collar 30 may be fashioned in many other shapes and configurations each of which allows the partial insertion and rotation method of assembly described herein. FIGS. 7–9 illustrate a rectangular embodiment of the invention, FIG. 10 a square embodiment, FIG. 11 a diamond-shaped embodiment, FIG. 12 a truncated triangular embodiment, FIG. 13 a regular triangular embodiment, and FIG. 14 a rounded-triangular embodiment. In each of the figures, structural features corresponding to those described above in connection with FIGS. 1–4 are referred to with similar reference numerals followed by the letters *a, b, c, d, e* and *f* with respect to the individual embodiments referred to above.

In one aspect, however, the embodiment shown in FIGS. 7–14 differs slightly from that in FIGS. 1–4 with respect to an item other than shape and contour. As shown in FIG. 9, base 22*a* projects beyond the top surface of flange 40*a* such that those two surfaces are not generally flush after assembly. However, the rear surfaces of collar 30*a* and base 22*a* do remain nearly flush for application to a generally planar support surface as shown in FIG. 2 as mentioned above. In addition, the corners of base 22*a* are slightly truncated as shown in FIG. 8 in order to allow easier assembly of the base and retaining collar.

Generally, the embodiments shown in FIGS. 10–14 are similar to the embodiments shown in FIGS. 7–9 in function and features except for their varying configurations, outlines and shapes. In the case of each of the embodiments in FIGS. 7–14, the thicknesses of the base members 22*a* through 22*f*, respectively, is less than the length and width of the aperture defined by the retaining collar to allow the partial insertion and rotation method of assembly described hereinafter.

METHOD

Figure 5:
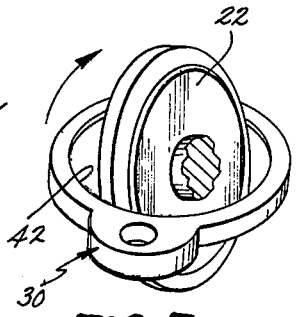
FIG. 5 is a fragmentary, perspective view of the first step of the assembly of the base of the support with the retaining collar.
Figure 6:
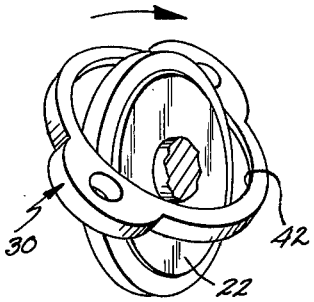
FIG. 6 is a fragmentary, perspective view of the second step of assembling the base with the retaining collar.

Referring now to the various figures and especially FIGS. 5 and 6, the method for assembling the support assembly illustrated in FIGS. 1–4 and 7–14 will now be apparent. As mentioned above, because the support 12 with arms 14, 16 itself is too large to allow passage of the retaining collar 30 thereover for seating in an overlapping manner over the base 22, the present partial insertion and rotation assembly method has been discovered to allow secure attachment of the base to a wall or other supporting surface by a continuous band-like flange on the retaining collar.

To begin the assembly, the end of the base 22 is inserted through the aperture 42 and retaining collar 30 from one side at an angle to the axis of the aperture such that the thickness of the base passes through the aperture. A portion of the collar 30 passes over the top surface of base 22 into the area between either support arm 14 or 16 and the top surface of the base with the limit of such extension being the side surface of connecting neck 20 between the base and central portion 18. Assembly of the collar and the base is made especially easy if approximately one-half of the total area of the base 22 is passed through aperture 42 before rotation is begun, although this is not essential to assembly of the parts.

After the above partial insertion, one of the collar or base is rotated with respect to the other around one or more axes as shown in FIG. 6 such that the remainder of the base passes through aperture 42 to a position behind the collar 30. Depending on the amount of base 22 initially passed through aperture 42, it may also be necessary to shift the base laterally or longitudinally within or behind the aperture during the rotation. Such rotation and/or shifting begins at the angle of insertion and ends at a position in which the top surface of the base 22 and the edge 42 of the aperture through the base are substantially parallel. In such position, the general plane of base 22 will be substantially normal to the axis of the aperture 42 as is shown in FIG. 2. Thereafter, the base is pushed into the pocket or recess formed by the flanges 39, 40 on collar 30 such that the rear surface of flange 40 engages the top surface of the recessed shoulder 28 with the rear surfaces of the collar and base portions being nearly flush. At least with respect to the embodiment shown in FIGS. 104, the top surfaces of the flange and base will also be flush after such assembly.

Thereafter, the assembled collar and base may be seated against a wall surface which includes holes or recesses for receipt of projections 29 to prevent rotation. Screws S′ may be inserted through aperture 36 in the collar to firmly secure collar 30 to the wall whereby base 22 is reliably and securely entrapped within the pocket of the collar and behind the retaining flange 40 of the collar. If additional securement is desired, and the rear of the wall W or other panel to which the support is secured with the collar is accessible, a pair of additional screws S may be inserted from the rear of the wall W into the threaded apertures or projections 29 for additional retention.

It will, therefore, be seen that the collar does not require an aperture equivalently sized to the outer periphery of the base 22 but rather has an aperture sized smaller than that outer periphery to provide an overlapping, secure retention after assembly. The unique method of the present invention which provides for partial insertion followed by rotation, shifting and seating of the base behind the collar allows the use of the continuous band-like collar even though the secure overlapping attachment is provided.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows:

1. A support assembly comprising a support such as a hook for hanging garments and the like and attaching means for attaching said support to a supporting surface; said support including a base for engaging a supporting surface; said attaching means including a collar for holding said base against the supporting surface, said collar having a base-receiving aperture extending therethrough and securing means for securing said collar to the support surface, said collar extending continuously around said base such that said collar engages said base therearound; the length, width and diagonal dimensions of said base being greater than the corresponding dimensions of said collar aperture, at least one dimension of said base being less than one dimension of said collar aperture; said base and collar including cooperating means for initially allowing insertion of only a portion of said base through said base-receiving aperture and thereafter allowing rotation of one of said base and collar with respect to the other of said base and collar to insert the remainder of said base through said aperture behind said collar; said base having a shape corresponding to that of said collar; said collar having recess means corresponding in shape to said base for receiving said base therewithin with the rear surfaces of said base and collar being generally flush after assembly and adapted to engage the support surface whereby said collar with overlap said base after assembly to hold said base against the support surface.

2. The support assembly of claim 1 wherein the outside periphery of said base defines an area larger than said base receiving aperture of said collar.

3. The support assembly of claim 1 wherein the maximum thickness and width of said base are less than the length of said base-receiving aperture of said collar.

4. The support assembly of claim 1 wherein said collar forms a continuous band extending around the entire periphery of said base.

5. The support assembly of claim 4 wherein at least the outside edge of said base generally corresponds to the shape defined by the periphery of said collar.

6. The support assembly of claim 4 wherein at least the peripheral edge of said base-receiving aperture in said collar corresponds to the shape defined by the periphery of said base.

7. The support assembly of claim 6 wherein said base includes a recessed shoulder extending around its outer periphery, said collar having an inwardly extending flange including the peripheral edge of said base-receiving aperture received in said recessed shoulder to hold said base against the support surface.

8. The support assembly of claim 7 wherein the exterior surface of said inwardly extending collar flange is flush with the exterior surface of said base after assembly; said recessed shoulder extending continuously around said base and corresponding to the shape defined by said collar flange .

9. The support assembly of claim 7 wherein the front surface of said recessed shoulder and the inside surface of said collar flange which engages said shoulder are correspondingly inclined to the plane including the rear surface of said base which engages the supporting surface.

10. The support assembly of claim 1 wherein said cooperating means include an inwardly extending continuous flange defining said base-receiving aperture and the peripheral edge of said base; said collar flange having an interior surface; said base having a top, exposed surface and a thickness less than either the width and length of said base-receiving aperture whereby said base is initially partially inserted through said base-receiving aperture at an angle to its ultimate position in said collar with at least a portion of said collar extending over the top of said base spaced inwardly of said base peripheral edge, at least one of the base and collar being rotated until all portions of said base periphery pass through said aperture, and finally the base is positioned in said recess means for receiving said base behind and against said interior surface of said collar flange.

11. The support assembly of claim 1 including a projection of a size sufficient to prevent passage of said collar thereover and joined to said base by a connecting portion at a generally central location such that said base extends laterally outwardly from such location around the periphery of said connecting portion; said connecting portion spacing the remainder of said projection away from said base whereby said collar will fit between said projection and base during assembly.

12. The support assembly of claim 1 wherein the outside peripheral edge of said base generally corresponds to the shape defined by the periphery of said collar.

13. The supports assembly of claim 1 wherein said base includes means projecting from its rear surface for engaging a supporting surface to prevent said support from rotating on said supporting surface.

14. The support assembly of claim 14 including means accessible for the rear of said base on said base for securing said base, and thus said support to a supporting surface.

15. The support assembly of claim 1 wherein said recess means for receiving said base include a recessed pocket opening to the rear of said collar and communicating with said base-receiving aperture for receiving said base after assembly with said collar.

16. A support assembly comprising a support having a base for securing said support to a surface, and attaching means including a continuous flange outlining and continously engaging the entire periphery of and overlapping the peripheral edge of said base for holding said base and support against a surface, recess means corresponding in shape to said base for receiving said base behind said attaching means such that the rear surface of said base and attaching means are generally flush after assembly, means for securing said attaching means to a surface, and an aperture for receiving said base therethrough, said flange defining the edge of said aperture; the outer periphery of said base being larger than the peripheral edge of said base-receiving aperture but having a shape corresponding to that of said aperture, the length, width and diagonal dimensions of said base being greater than the corresponding dimensions of said base-receiving aperture, at least one dimension of said base being less than one dimension of said base-receiving aperture whereby the assemble said base and attaching means, said base is first passed only partially through said aperture in said attaching means from the front side thereof, is secondly rotated with respect to said attaching means or vice versa to pass the remainder of said base through said aperture, and thirdly is seated behind and against said attaching means and especially the undersurface of the peripheral edge of said base-receiving aperture within said recess means with said rear surfaces generally flush with one another.

17. The support assembly of claim 16 wherein said attaching means is a continuous collar extending entirely around said base periphery; said recess means including a recessed area within said collar behind said continuous flange, said flange being spaced outwardly of the rear edge of said collar to define said recessed area for receiving said base.

* * * * *

UNITED STATES PATENT AND TRADEMARK OFFICE

CERTIFICATE OF CORRECTION

PATENT NO. : 4,082,243

DATED : April 4, 1978

INVENTOR(S) : WILLIAM DOYLE WATT, JR. and DALE L. FLOWERDAY

It is certified that error appears in the above-identified patent and that said Letters Patent are hereby corrected as shown below:

Column 4, Line 25:

There should be a period after "collar"

Column 7, Line 11, Claim 1:

"with" should be --will--

Column 7, Line 17, Claim 2:

"base receiving" should be --base-receiving--

Column 7, Line 37, Claim 7:

"support" should be --supporting--

Column 8, Line 16, Claim 13:

"supports" should be --support--

Column 8, Line 20, Claim 14:

"14" should be --13--.

UNITED STATES PATENT AND TRADEMARK OFFICE

CERTIFICATE OF CORRECTION

PATENT NO. : 4,082,243

DATED : April 4, 1978

INVENTOR(S) : WILLIAM DOYLE WATT, JR. and DALE L. FLOWERDAY

It is certified that error appears in the above-identified patent and that said Letters Patent are hereby corrected as shown below:

Column 8, Line 21, Claim 14:

"for" (first occurrence) should be --from--

Column 8, Line 48, Claim 16:

"the" should be --to--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*